US007651451B2

(12) United States Patent
Jensen

(10) Patent No.: US 7,651,451 B2
(45) Date of Patent: Jan. 26, 2010

(54) MULTIPLE MUSCLE EXERCISING DEVICE

(76) Inventor: John B. Jensen, 1661 Merlin La., Windsor, CO (US) 80550

( * ) Notice: Subject to any disclaimer, the term of this patent is extended or adjusted under 35 U.S.C. 154(b) by 0 days.

(21) Appl. No.: 11/744,481

(22) Filed: May 4, 2007

(65) Prior Publication Data

US 2008/0274863 A1 Nov. 6, 2008

(51) Int. Cl.
*A63B 21/02* (2006.01)

(52) U.S. Cl. ..... 482/124; 482/122

(58) Field of Classification Search ..... 482/121, 482/122, 124, 125, 126; 2/90, 76, 221
See application file for complete search history.

(56) References Cited

U.S. PATENT DOCUMENTS

| | | | | | |
|---|---|---|---|---|---|
| 1,663,641 | A | * | 3/1928 | Smallwood | 482/124 |
| 2,224,103 | A | * | 12/1940 | Nilson | 482/124 |
| 2,434,809 | A | * | 1/1948 | Northrup | 2/90 |
| 3,529,820 | A | | 9/1970 | Templeton | |
| 4,540,173 | A | * | 9/1985 | Hopkins, Jr. | 482/124 |
| 4,591,150 | A | * | 5/1986 | Mosher | 482/125 |
| 4,852,874 | A | | 8/1989 | Sleichter, III | |
| 5,316,533 | A | * | 5/1994 | Hoker | 482/121 |
| 5,318,494 | A | * | 6/1994 | Santighian | 482/125 |
| D353,172 | S | | 12/1994 | Gaut | |
| 5,518,481 | A | * | 5/1996 | Darkwah | 482/126 |
| 5,573,487 | A | * | 11/1996 | Wallner | 482/124 |
| 5,614,300 | A | * | 3/1997 | Cicali et al. | 482/122 |
| 5,711,747 | A | * | 1/1998 | Steinback | 482/124 |
| 5,857,945 | A | * | 1/1999 | Papp et al. | 482/124 |
| 6,128,783 | A | * | 10/2000 | Blauer et al. | 2/90 |
| 6,179,760 | B1 | * | 1/2001 | Rumbaugh | 482/121 |
| 6,368,255 | B1 | * | 4/2002 | Chan-Rouse | 482/91 |
| 6,450,930 | B1 | * | 9/2002 | Kroke | 482/121 |
| 2005/0079963 | A1 | * | 4/2005 | Lin | 482/126 |
| 2007/0232468 | A1 | * | 10/2007 | Levy et al. | 482/121 |

* cited by examiner

*Primary Examiner*—Fenn C Mathew
*Assistant Examiner*—Andrew M Tecco
(74) *Attorney, Agent, or Firm*—William W. Cochran; Christopher P. Whitham; Cochran Freund & Young LLC

(57) ABSTRACT

There is provided by this invention a portable, elastic, and resilient exercising sleeve that can be placed around the torso and the extremities of the body for performing muscle strengthening and conditioning exercises that is generally comprised of a large elastic oblong center section having connected at opposite ends thereof a plurality of smaller elastic positioning sections with the large oblong center section and the smaller positioning sections co-joined to form a one piece multiple muscle exercise device. The exercising sleeve is disposed to receive the extremities of the human body for stretching and strengthening the muscles.

10 Claims, 1 Drawing Sheet

MULTIPLE MUSCLE EXERCISING DEVICE

BACKGROUND OF THE INVENTION

1. Field of the Invention

This invention relates generally to muscle exercising devices and more particularly to muscle exercising devices that accommodates different muscles of the body with different strengths and leverages by expanding and contracting a flexible member with a controlled maximum flex. The muscle exercising device can be put into position without any latches, buckles, clasps, connectors, etc.

2. Brief Description of the Prior Art

It is well known to provide portable elastic devices for performing exercises. One such type of exercise device employs an elastic cord, and a pair of handles fixed to the ends of the cord. Such portable exercising devices are generally inexpensive, convenient for use, and are useful to provide resistance against which the user exerts force during exercising.

See U.S. Pat. No. 4,852,874, which describes an exercise device comprising an elastic loop having free ends spliced together, generally tubular handles disposed in diametrically opposed relation to one another on the loop and an elastic retainer sleeve surrounding intermediate portions of the loop between the handles. The device is designed for use in performing a wide variety of exercises and for performing a selected number of repetitions of each exercise by grasping the handles and stretching against the resistance load of the loop and the retainer means. The handles can be grasped either by the hands or by a combination of hands and feet to perform various exercises or may be grasped between the feet or ankle portions to perform other exercises.

The problem with elastic exercising devices that rely on handles to extend the device is that individuals are relying on hand and finger strength to hold on as the recoil increases. When one is limited to finger and hand strength then maximizing the big muscles may not be accomplished. Also, the handles could slip out of the hands with increased pressure. This could result in injury.

However, see U.S. Pat. No. 3,529,820, which describes an exercising device for bust development through forced use of the muscles of the back, shoulders and chest consisting of an elastic cord having a sleeve loosely mounted thereon for the arms and shoulders. This device is limited to the upper portion of the body.

U.S. Pat. No. 5,711,747 discloses an exercise device for exerting a resilient force upon the limbs of the user having two cuffs and a continuously formed looped tension band. Provided on the exterior of the cuff is an envelope-like enclosure having a closure which is formed from the same hook and loop synthetic materials such as those sold under the trademark VELCRO, whereby the tension band is placed within the flaps of the envelope-like enclosure and the flaps are secured about the tension band. In use, the cuffs are secured about the limbs of the user using the VELCRO strips. Once secured, the envelope-like enclosure is then positioned on the exterior aspect of the limb. The chosen continuously formed tension band is positioned and secured within the envelope-like enclosure of each cuff. The user when moving the limbs in opposite directions receives a resilient force, thereby exercising the limbs associated with the exercise device.

SUMMARY OF THE INVENTION

There is provided by this invention an elastic exercise sleeve that is generally comprised of several positioning sleeves co-joined to one larger middle sleeve to make a one piece versatile, variable positioning, multiple muscle exercise, stretching and strengthening sleeve. The larger sleeve in the middle receives the larger and wider part of the extremities, such as above the knees on the legs and above the elbows on the arms. Several smaller sleeves connected to the larger sleeve receive the areas below the knees on the legs and below the elbows on the arms. Having several versatile sleeves provides a variety of options for exercising body parts. The apparatus is a portable exercise system generally comprised of a light weight fabric design.

BRIEF DESCRIPTION OF THE PREFERRED EMBODIMENTS

Figure 1:
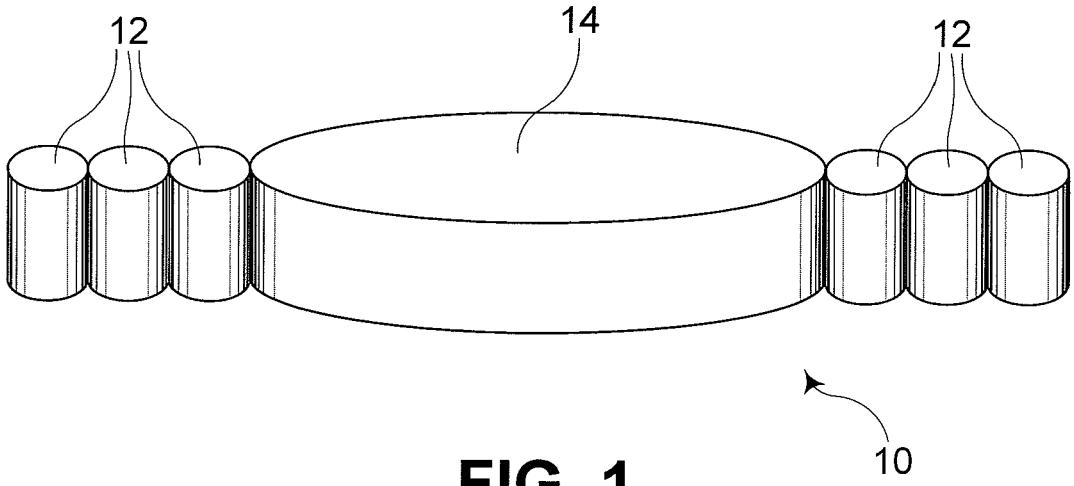
FIG. 1 is a perspective view of an elastic exercise sleeve incorporating the principles of this invention.
Figure 2:
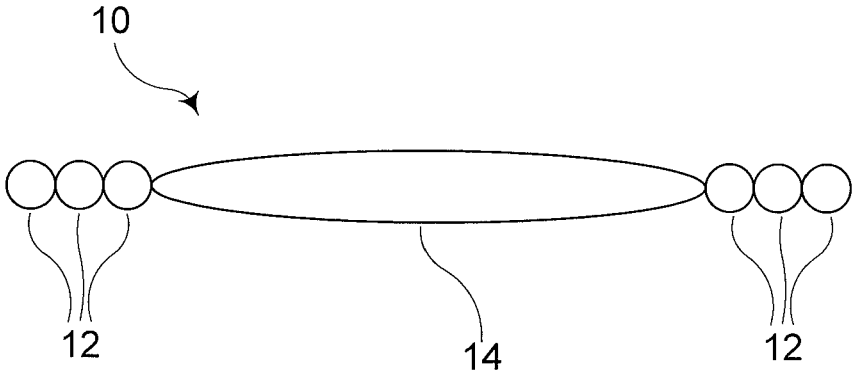
FIG. 2 is a top view of an elastic exercise sleeve incorporating the principles of this invention.

Referring to FIG. 1 there is shown an elastic exercising apparatus 10 that is generally comprised of several positioning sleeves such as 12 co-joined to one larger middle sleeve 14 forming a one piece versatile and various positioning, multiple muscle exercise, stretching and strengthening sleeve. The positioning sleeves 12 can accommodate either the arms or legs. The larger sleeve 14 is designed for the larger and wider part of the extremities, such as above the knees on the legs and above the elbows on the arms. The sleeve 14 can accept one or two legs, together, and the several smaller sleeves 12 can slide onto area below the knees on the legs and below the elbows on the arms providing multiple positioning for flexing muscles. The exercise sleeves form around the body in various ways, utilizing ones own body structure for leverage, creating resistance by using ones own strength, flexing and engaging different muscles from various positions for defining, maintaining, stretching and increasing muscle mass.

Exercise sleeve 10 is made up of two different knits of material to accommodate different sizes of individual bodies. The middle or main part 16 (see FIG. 3) of the sleeve consists of jersey or sportswear knit fabric or similar material, which has some stretch and is very strong, but will max out in a short length and not increase the opposing force or recoil effect dramatically for any individual's strength at various positions. The exercise sleeve 10 does not have to be adapted according to the individual's own strength. Unlike latex or rubber bands, there is no need for different size bands for increasing or decreasing resistance. The exercise sleeve 10 also does not have a big recoil effect that highly elastic rubber bands have. With rubber bands, the longer the band is stretched, the force to retract increases, which limits the ability of the individual to hold it at maximum resistance. With rubber bands, the force to retract increases the longer the band is stretched, which limits the ability of the individual to hold it at maximum resistance. The exercise sleeve 10 does not have an increased recoil effect, which allows individuals to maintain maximum engagement longer without a huge opposing force.

Also, because there is not a major retracting force with this exercise sleeve design, individuals can have more control with proper position formation. The outside edges 17 & 18 (see FIG. 3) of the sleeve consist of a rib knit fabric or similar material which expands and retracts universally allowing different sized individuals to slip hands and feet through easily and quickly without any latches, buckles, Velcro, etc. The fabric retracts snug to the final placement of individual extremities holding the sleeve in place. Exercise sleeve 10 promotes a comfortable fit and allows easy rotation of extremities while placed in sleeves without having to unbuckle, unsnap, unscrew, or re-adjust. The user just simply turns to a different position.

The exercise sleeve 10 has multiple, universal, self fitting sleeves 12, for different positions, that slide past wrists and ankles for low impact, utilizing big muscles and eliminating the strength limitations of hands, feet, wrists, and ankles. The sleeves are aligned in different placements so individuals can quickly slide extremities out of one sleeve and into another providing different positioning for muscle workout. The sleeves 12 can also be gripped by the hands to strengthen hand and wrist strength. The larger sleeve 14 is in the middle to accommodate various positions and larger part of legs and wider spread of the arms. It also allows working of arms and shoulder muscles at the broader area by the shoulders.

The exercise sleeve 10 is a one piece, soft, and compact portable design for taking on trips, etc. It does not utilize latches, weights, pulleys, or cables that are common with most exercise equipment. No assembly is required. The exercise sleeve 10 does not require any other structure to utilize it. The exercise sleeve 10 can be used while walking.

Figure 3:
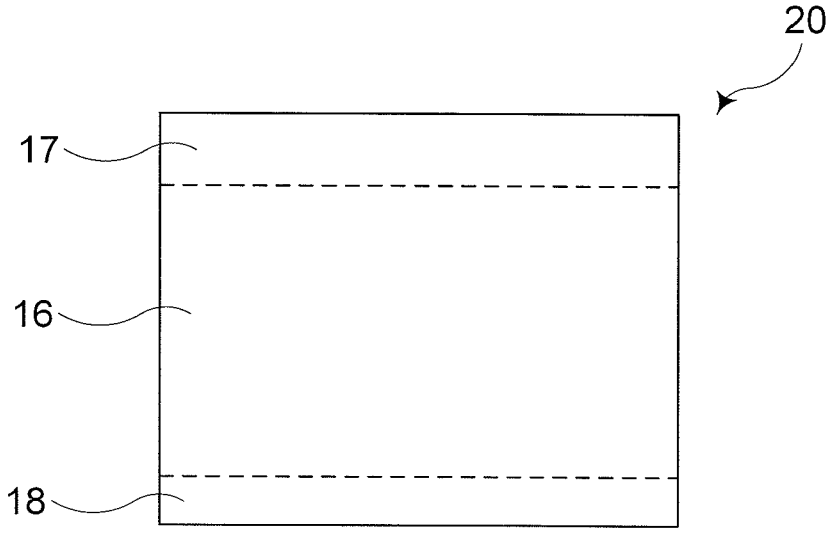
FIG. 3 is a block diagram view of a portion of the sleeve showing the middle part of the sleeve and the edges of the sleeve.

FIG. 3 is a block diagram view of a portion of the sleeve showing the middle part 16 of the sleeve and the edges 17 & 18 of the sleeve. The block diagram 20 of the sleeve indicates a middle or main part 16 of the sleeve and edges 17 & 18 of the sleeve.

The exercise device 10 may be used in numerous types of exercises, such as the overhead butterfly, frontal butterfly, arm extensions across the back, lateral chest pull and shoulder raise, side bends, back conditioner similar to sit-ups, leg presses, curls and raises, push-ups, and stomach crunches, etc.

Butterfly curls may be performed by placing the sleeve 10 behind the back and placing the wrists through the sections 12 at opposite ends of the sleeve 10 and bringing the arms together in an exercising motion well known.

Arm or wrist curls may be performed by passing one foot through section 12 at one end of the sleeve 10 and grasping another section of 12 at the opposite end of the sleeve 10.

The exercise sleeve 10 may be used in performing leg squats by placing the exercise sleeve 10 beneath the feet, grasping the sections 12 in the hands on opposite sides of the legs, and undergoing a series of squats by bending and extending the body in a manner well known.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

I claim:

1. A stretchable and strong device that can be placed around a torso and extremities of a human body for performing muscle stretching, strengthening and conditioning exercises comprising:

a length of strong knit fabric material that stretches a short length before reaching a maximum stretch and has minimal recoil after being stretched in comparison to a length of rubber band material;

a first length of a rib knit fabric material attached to a top edge of said length of said strong knit fabric material that expands and contracts universally such that when said rib knit fabric material is wrapped around said torso and said extremities of said human body said rib knit fabric snugs into place for said muscle stretching, strengthening and conditioning exercise;

a second length of said rib knit fabric material attached to a bottom edge of said length of said strong knit fabric material creating a length of two knit fabric material; and a large oblong center sleeve having connected at opposite ends thereof a plurality of smaller positioning sleeves, said large oblong center sleeve and said plurality of smaller positioning sleeves being fashioned from said length of two knit fabric material, said large oblong center sleeve and said plurality of smaller positioning sleeves further being fashioned into a single unit to form a one piece multiple muscle exercise device disposed to receive said extremities and said torso of said human body for said muscle stretching, strengthening and conditioning, said large oblong center sleeve having a top and a bottom opening disposed in a first direction, said plurality of smaller positioning sleeves having top and bottom openings disposed in a direction equivalent to said first direction of said large oblong center sleeve, said top and bottom openings of said large oblong center sleeve and said plurality of smaller positioning sleeves being disposed such that said top and bottom openings do not open into said other sleeves.

2. The device of claim 1 wherein said strong knit material is comprised of jersey material.

3. The device of claim 1 wherein said strong knit material is comprised of sportswear knit fabric material.

4. The device of claim 1 wherein said one piece multiple muscle exercise device is compact and portable.

5. The device of claim 1 wherein said large oblong center sleeve is sized to accommodate larger and wider parts of said human body.

6. The device of claim 1 wherein said larger and wider parts of said human body comprise at least one of the group comprising: both arms, both legs, above knees on legs, above elbows on arms, and torso.

7. The device of claim 1 wherein said plurality of smaller positioning sleeves are sized to accommodate smaller parts of said human body.

8. The device of claim 7 wherein said smaller parts of said human body comprise at least one of the group comprising: arm below elbow, leg below knee, wrist, ankle, hand, and foot.

9. The device of claim 1 wherein said large oblong center sleeve is sized such that said maximum stretch of said strong knit fabric material permits said torso and said extremities to reach said maximum stretch before reaching a maximum displacement position for said muscle stretching, strengthening and conditioning exercises such that said muscle stretching, strengthening and conditioning exercise may be performed up to a maximum strength limit of said human body.

10. The device of claim 1 wherein said first and second lengths of said rib knit fabric material attached to said top and bottom of said length of said strong knit fabric material are adapted to snug against said torso and said extremities of said human body so as to eliminate a need for additional attachment mechanisms.

* * * * *